United States Patent [19]

Duval

[11] Patent Number: 4,698,276

[45] Date of Patent: Oct. 6, 1987

[54] DIFFERENTIAL DENSITY FABRIC

[75] Inventor: Paul A. Duval, Greensboro, N.C.

[73] Assignee: Guilford Mills, Inc., Greensboro, N.C.

[21] Appl. No.: 866,799

[22] Filed: May 23, 1986

[51] Int. Cl.[4] ..... B32B 3/12

[52] U.S. Cl. ..... 428/116; 428/192; 428/193; 428/218; 428/247; 428/253

[58] Field of Search ..... 428/116, 192, 193, 218, 428/247, 253

[56] References Cited

U.S. PATENT DOCUMENTS

| | | | |
|---|---|---|---|
| 4,268,561 | 5/1981 | Thompson et al. | 428/251 |
| 4,450,027 | 5/1984 | Colson | 428/116 |
| 4,603,072 | 7/1986 | Colson | 428/116 |

FOREIGN PATENT DOCUMENTS

| | | | |
|---|---|---|---|
| 2508953 | 9/1976 | Fed. Rep. of Germany | 428/218 |
| 917276 | 1/1963 | United Kingdom | 428/218 |
| 2056913 | 3/1981 | United Kingdom | 428/218 |

*Primary Examiner*—James J. Bell

*Attorney, Agent, or Firm*—Shefte, Pinckney & Sawyer

[57] ABSTRACT

A sheer textile fabric for use in forming expandable honeycomb window panels, such fabric comprising a plurality of strips of fabric, each strip having a center portion and two spaced end portions formed with a sufficient fabric density to avoid the seepage therethrough of a liquid adhesive used to join the center portion of one strip to the end portions of another strip, and each strip having intermediate portions extending between the center portion and the two end portions thereof, such intermediate portions being formed of a sheer fabric having a fabric density substantially less than the fabric density of the center and end portion. These intermediate portions may be made of varying colors and/or fabric densities to thereby vary the appearance and/or functional aspects of the window panels formed from the textile fabric.

9 Claims, 5 Drawing Figures

DIFFERENTIAL DENSITY FABRIC

BACKGROUND OF THE INVENTION

The present invention relates generally to a specially formed fabric having differential densities, and more particularly to a fabric that is specially designed in a manner that permits it to be readily formed into expandable honeycomb panels that can be utilized to provide practical, aesthetically pleasing decorative window coverings.

Colson U.S. Pat. No. 4,450,027 discloses a method and apparatus for forming expandable honeycomb insulation panels from thin film plastic material, whereby the panels have desirable energy conservation characteristics by virtue of their insulating and heat collective properties, as well as being aesthetically pleasing when used as window coverings. Briefly summarized, such patent discloses the concept of continuously creasing and folding strips of thin plastic film into an open sided tubular structure, then heat setting the folds in the film, and applying liquid adhesive to the portions of the film to be joined together to form the expandable honeycomb configuration.

Efforts have also been made to form expandable honeycomb panels from textile fabric materials rather than plastic to enhance the aesthetic appeal of the panels while sacrificing to some extent the energy conservation function of the panels. In attempting to form these panels from conventional thin fabric materials, a significant problem has been presented in terms of using a liquid adhesive to join the fabric to itself to provide the desired expandable honeycomb configuration.

When a textile fabric is used to make these panels, it must be quite sheer to provide the desired aesthetic and functional qualities normally associated with conventional sheer curtains and the like, but the open-mesh characteristic of this type of sheer fabric makes it virtually impossible to apply a liquid adhesive to the fabric solely at the required points of fabric juncture without also having the adhesive flow through the open-mesh sheer fabric to join other parts of the fabric to itself in a manner that will prevent proper expansion of the plurality of the individual honeycomb segments that make up the entire window panel. More specifically, when the individual segments are properly folded for ultimate expansion and contraction, the end portion of each such folded segment must be adhesively joined only to the center portion of the next adjacent segment, without any adhesive seeping through this point of juncture to cause adhesion at the end portions of an individual segment to the center portion of the same segment, which would prevent the necessary expansion of the individual segment when the final panel is used as a window covering. However, because of the aforesaid open-mesh construction of conventional sheer fabric, it is virtually impossible to prevent this seepage of adhesive during production of panels in high volume, commercially feasible manufacturing equipment.

In accordance with the present invention, a specially designed differential density fabric is provided which overcomes the above-described practical drawbacks of using a sheer textile fabric to form an expandable honeycomb window panel.

SUMMARY OF THE INVENTION

The textile fabric of the present invention comprises a plurality of adjacent strips of fabric extending parallel to one another, and each strip is formed with a longitudinally extending center portion having a predetermined width and a predetermined high fabric density, two end portions extending generally parallel to the center portion in spaced relation thereto, each such end portions also having a predetermined high fabric density and having a width substantially one-half the width of the center portion, and two intermediate portions extending respectively between said center portion and each of said end portions, said intermediate portions being formed of an open-mesh fabric having a substantially lesser density than said predetermined fabric density of the center portion and the two end portions.

The predetermined fabric density for the center portion and the two end portions of each strip is sufficiently high so that when a measured quantity of liquid adhesive is applied to join the two end portions of one strip to the center portion of an adjacent strip, such adhesive will not seep through the joined center portion and end portions.

The two intermediate portions of each strip may be formed of identical fabric construction or they may be formed of contrasting colors and/or contrasting degrees of sheerness (e.g. one being generally opaque and the other being generally translucent).

In the preferred embodiment of the present invention, a plurality of strips are formed in parallel relation to one another as one sheet of fabric material, with at least one of the end portions of each of said strips being joined to an adjacent end portion of another of such strips by connecting yarns having a sufficiently low density to permit each such strip to be separated from an adjacent strip by tearing or cutting without damage to the structural integrity of the separated strips.

DESCRIPTION OF THE PREFERRED EMBODIMENT

Figure 1:
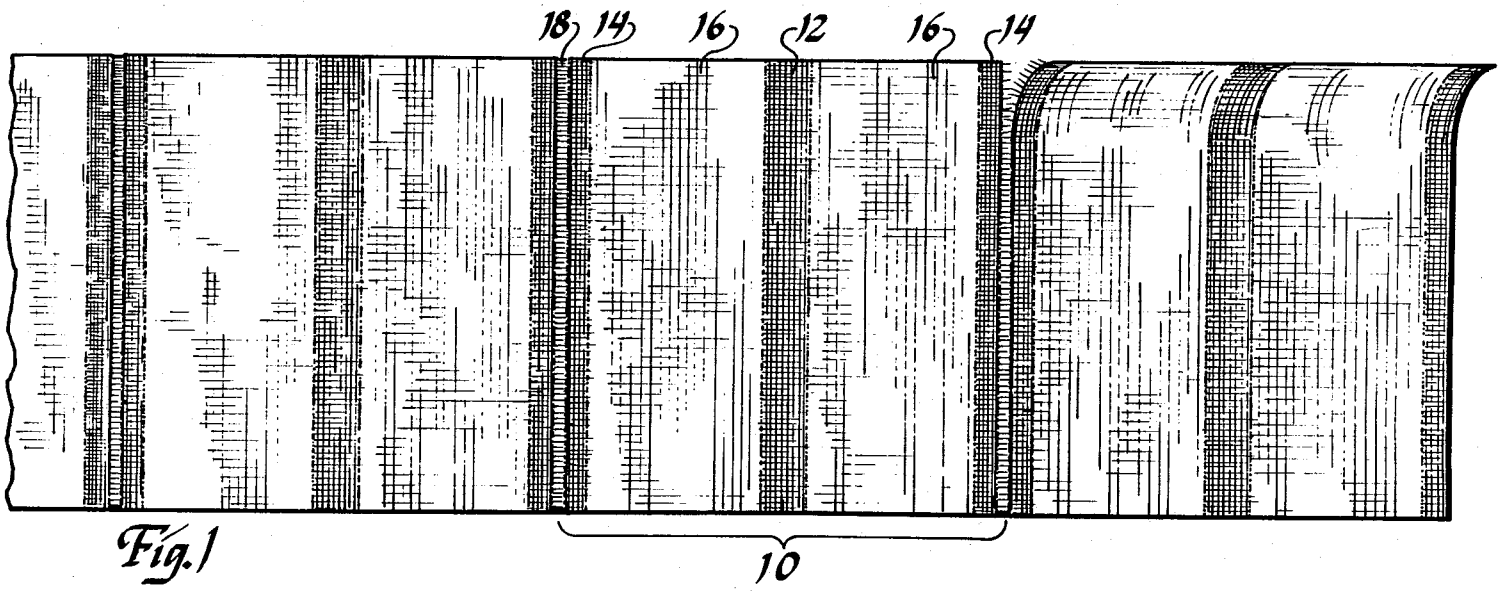
FIG. 1 is a plan view of a sheet of textile fabric formed according to the present invention.

Looking now in greater detail at the accompanying drawings, FIG. 1 is a plan view of a portion of a sheet of textile fabric constructed in accordance with the present invention. This sheet of fabric includes a plurality of identical strips 10 extending in parallel relation to one another.

Each such strip 10 is comprised of a longitudinally center portion 12 having a predetermined relatively high fabric density of a magnitude to be discussed below. Each strip 10 also includes two end portions 14 extending parallel to the center portion 12 and having a fabric density equal to that of the center portion, each end portion 14 having a width that is approximately one-half of the width of the center portion 12. Intermediate portions 16 extend, respectively, between the center portion 12 and each or the end portions 14, each said intermediate portion 16 being formed of an open-mesh fabric having a substantially lesser fabric density than that of the center portion 12 and the end portion 14.

Each strip 10 is joined to an adjacent strip 10 by a small number of yarns 18 extending between one end portion 14 of one strip 10 to an adjacent end portion 14 of the next strip 10 as illustrated in FIG. 1, the size and number of the yarns 18 being selected to have sufficient strength to maintain the strips 10 as an integral sheet of fabric during manufacture and handling thereof, but being sufficiently fragile to permit the adjacent strips 10 to be readily separated from one another by tearing or cutting without damage to the structural integrity of the strips during or after such separation. For purposes of illustration, one of the strips 10 is shown partially separated from an adjacent strip 10 along the separation line provided by the connecting yarns 18.

Figure 2:
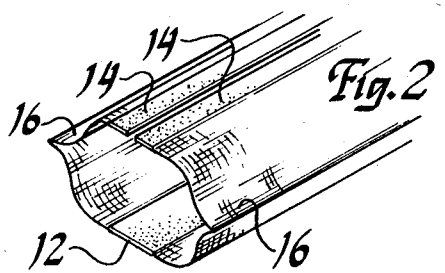
FIG. 2 is a detail view illustrating the manner in which one strip of fabric material is folded before being joined by an adhesive to an adjacent strip of material.

To form an expandable honeycomb panel of the type described above, suitable equipment, which forms no part of the present invention, is employed to separate the strips 10 from one another and manipulate the individual strips 10 in a manner that permits them to be joined together by a conventional liquid adhesive to provide a composite panel. As best illustrated in FIG. 2, each strip 10 is manipulated so that the two intermediate portions are folded at their approximate longitudinal mid-lines, whereby the two end portions 14 are positioned adjacent one another, and in an overlapping and contiguous position with respect to the center portion 12 of the strip 10, it being noted that since the width of each end portion 14 is approximately one-half of the width of the center portion 12, the combined width of the two end portions 14 is the same as that of the center portion 12 in the overlapping disposition illustrated in FIG. 2.

Figure 3:
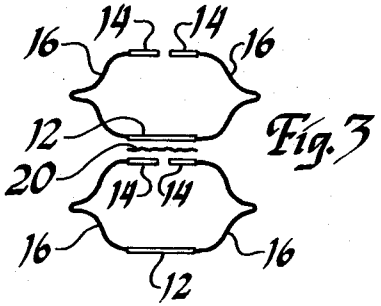
FIG. 3 is a detail view illustrating the manner in which one folded strip of fabric material is joined to an adjacent strip.

The next step in forming the panel is to join one strip 10 to another, this step being illustrated somewhat diagrammatically in FIG. 3 where the individual strips 10 are shown in a slightly expanded disposition for clarity of illustration, but during actual joining of adjacent strips during manufacture it is to be noted that the strips 10 would be fully contracted with the overlapping portions being immediately adjacent one another. As illustrated in FIG. 3, a measured quantity of a suitable liquid adhesive 20 is ejected or otherwise laid between the center portion 12 of one strip 10, and the two contiguous end portions 14 of the next adjacent strip 10 so that the adjacent strips 10 will be joined by the adhesive at this point.

In joining adjacent strips 10 together in this manner, it is important that the adhesive 20 only join the center portion 12 of one strip 10 to the end portions 14 of the next adjacent strip 10, and that this adhesive 20 not be permitted to seep through such joined portions in a manner that would result in the center portion 12 of any one strip 10 being joined to the end portions 14 of the same strip 10 because the result would prohibit the individual strips from assuming an expanded disposition during use, such expanded disposition being discussed in greater detail below. To avoid such seepage of the adhesive 20, both the center portion 12 and the two end portions 14 of each strip 10 are specially formed with a predetermined high fabric density that is high enough to prevent any seepage therethrough of the measured quantity of adhesive that is applied between the center portions 12 and the end portions 14 of the adjacent strips 10 as explained above.

Figure 4:
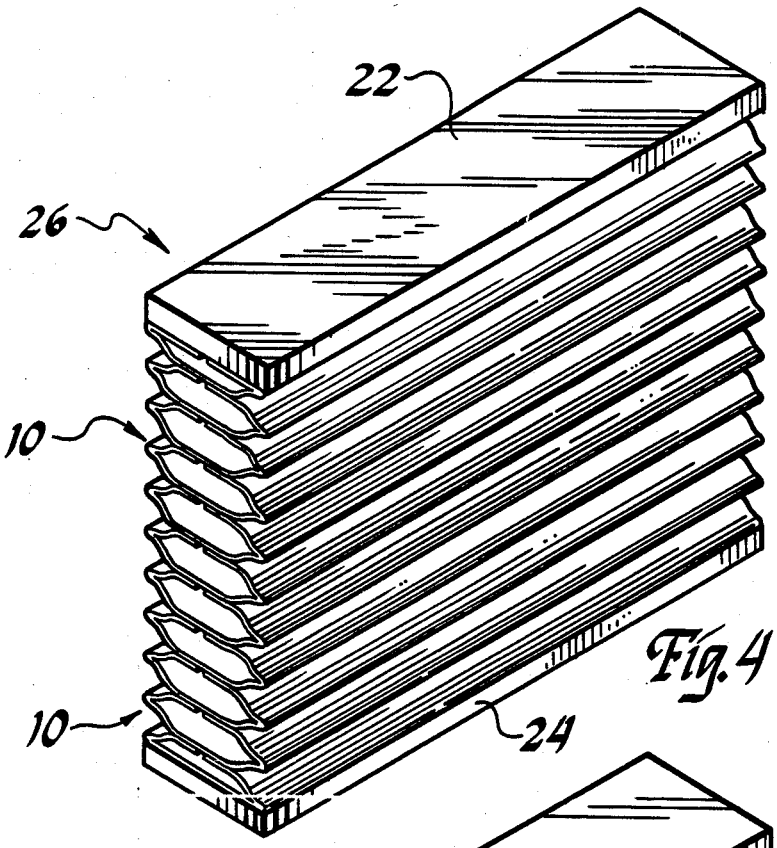
FIG. 4 illustrates a panel formed from the textile fabric material of the present invention in its expanded configuration.
Figure 5:
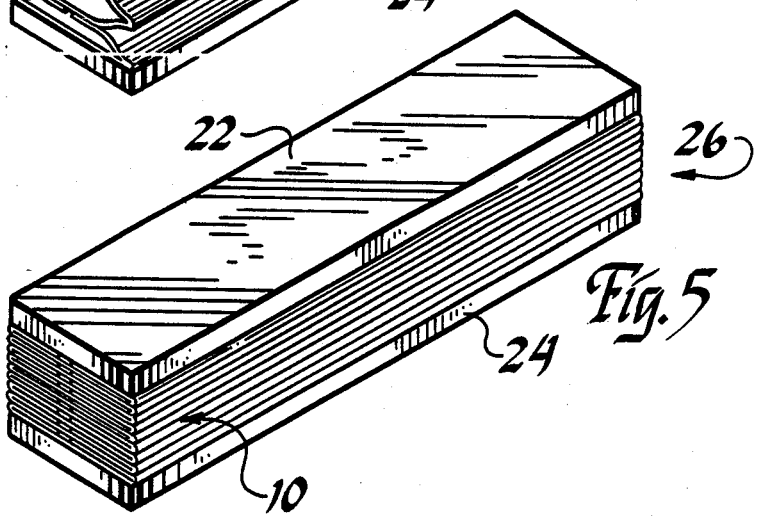
FIG. 5 illustrates the panel of FIG. 4 in its contracted configuration.

After a desired number of strips 10 have been formed and joined as described above, the resulting honeycomb of fabric may be mounted between an upper slat 22 and a lower slat 24 as illustrated in FIGS. 4 and 5 to complete the construction of a window panel 26. Because of the formation of the honeycomb fabric, the window panel 26 may be mounted in a window in a manner similar to that of venetian blinds so that it can be raised and lowered between a fully expanded disposition as illustrated in FIG. 4 or a fully contracted disposition as illustrated in FIG. 5, or any intermediate disposition. When the honeycomb fabric is fully or partially expanded, it will be noted that each individual strip 10 is formed in a generally diamond shape with only the very sheer fabric of the intermediate portions 16 of each strip 10 being generally visible, and with the higher density center portion 12 and end portions 14 of the strips 10 not being noticeably visible, so that the window panel 26 provides an attractive and aesthetically pleasing appearance generally similar to conventional sheer curtains but with the added decorative shape provided by the honeycomb construction of the fabric.

The construction of the fabric of the present invention also makes it quite versatile in terms of both aesthetic appeal and functionality. For example, when the strips 10 are formed, one of the intermediate portions 16 of each strip 10 may be made of one color (e.g. light blue) and the other intermediate portion 16 of each strip 10 may be made of a contrasting color (e.g. darker blue). When the construction of the window panel 26 is completed as illustrated in FIG. 4, it will be noted that all of the corresponding colored intermediate portions 16 of the various strips 10 are presented on one side of the finished window shade 26 to provide a consistent color on that side, whereas the other group of contrasting colored intermediate portions 16 are presented on the opposite side of the window panel 26, so that the user can select the desired color that will be visible by mounting the window panel 26 in the window with one side or the other exposed to normal viewing. Similarly, striped effects for the window panel 26 can be obtained by making the intermediate portions 16 of some strips 10 of one color and making the corresponding intermediate portions 16 of other strips 10 of a contrasting color or colors. Yet another variation would be to knit or otherwise form one intermediate portion 16 of each strip 10 with a very sheer fabric density so that it will be translucent and form the other intermediate portion 16 of each strip 10 with a fabric construction that is opaque. While the examples set forth above are illustrative of the versatility of the fabric construction of the present invention, it will be understood that many other variations are possible, all of which adds to the commercial acceptance of the window shades as both functional and highly decorative cover for windows and the like.

In a typical or representative strip 10 of fabric constructed in accordance with the present invention, the center portion 12 and the two end portions 14 of each strip 10 are formed of two individual warp knitting systems of 20 denier yarn that are knitted together with another individual warp knitting system of 78 denier yarn laid into the knitted fabric, and the intermediate portions 16 are formed of two individual warp knitting systems of 20 denier yarn knitted together. In the resulting fabric, the weight of the sheer intermediate portion is 0.98 ounces per square yard, and the weight of more dense end portions 14 and the center portion 12 is 2.28 ounces per square yard, over twice as dense as the intermediate portion 16. In terms of thickness, the intermediate portions 16 are about 0.008-inch in thickness, and the end portions 14 and center portion 12 have a thickness of about 0.012-inch.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limmit the present invention or otherwise to exclude any such other embodiments, adaptations, variations, modifications and equivalent arrangements, the present invention being limited only by the claims appended hereto and the equivalents thereof.

I claim:

1. A sheer textile fabric for use in forming expandable honeycomb window panels and the like, such textile fabric comprising a plurality of adjacent strips of fabric extending parallel to one another with each said strip being formed with a longitudinally extending center portion having a predetermined width and a predetermined high fabric density, two end portions extending generall parallel to said center portion and in spaced relation thereto, each of said end portions having a predetermined width substantially one-half of the said width of said center portion and having a predetermined high density, and two intermediate portions extending, respectively, between said center portion and said two end portions, said intermediate portions being formed of an open-mesh fabric having a substantially lesser fabric density than said center portion and said end portions.

2. A sheer textile fabric as defined in claim 1 and further characterized in that said predetermined density of said end portions and said center portions is high enough to prevent the seepage of a liquid adhesive therethrough when a predetermined amount of such adhesive is applied between the center portion of one of said strips and the end portion of an adjacent strip to provide adhesion between said center portion and said end portions.

3. A sheer textile fabric as defined in claim 1 and further characterized in that at least one of said end portions of each of said parallel extending strips is joined to an adjacent end portion of another of said strips by connecting yarns having a sufficiently low density to permit each said strip to be separated from an adjacent strip by tearing or cutting without damage to the structural integrity of said separated strips.

4. A sheer textile fabric as defined in claim 1 and further characterized in that the colors of the fabrics of said intermediate portion of each strip are different from one another.

5. A sheer textile fabric as defined in claim 1 and further characterized in that the fabric density of one of said intermediate portions of each said strip is sufficiently high to be generally opaque, and the fabric density of the other of said intermediate portions is sufficiently low to be generally translucent.

6. A sheer textile fabric as defined in claim 1 and further characterized in that the fabric density of said end portion and said center portion is at least twice as great as the fabric density in said intermediate portion in terms of weight per square yard.

7. A sheer textile fabric for use in forming expandable honeycomb window panels and the like, such textile fabric comprising a strip of fabric having a longitudinally extending center portion having a predetermined width and two end portions extending generally parallel to said center portion and in spaced relation thereto, each of said end portions having a predetermined width substantially one-half of said width of said center position, said center position and said two end portions being formed of two knitted yarn ends and a third yarn end laid into said knitted yarn ends to increase the fabric density thereof, and two intermediate portions extending, respectively, between said center portion and said two end portions, said intermediate portions being formed of two knitted yarn ends and having a substantially lesser fabric density than said center portion and said end portions.

8. A sheer textile fabric as defined in claim 7 and further characterized in that the fabric density of said intermediate portions is less than one-half the fabric density of said end portions and said center portion in terms of weight per square yard.

9. A sheer textile fabric as defined in claim 7 and further characterized in that said center portion, said end portions and said intermediate portions are formed from knitted yarn ends having the same denier, and in that said laid in yarn end in said center portions and said end portions has a substantially greater denier than that of said knitted yarn ends.

* * * * *